US009480993B2

(12) United States Patent
Drozd et al.

(10) Patent No.: US 9,480,993 B2
(45) Date of Patent: Nov. 1, 2016

(54) ADJUSTABLE NEEDLE PACKING ASSEMBLY FOR A SPRAY GUN

(71) Applicant: Finishing Brands Holdings Inc., Minneapolis, MN (US)

(72) Inventors: Mitchell M. Drozd, Harwood Heights, IL (US); Paul R. Micheli, Glen Ellen, IL (US); Nekheel S. Gajjar, Chicago, IL (US)

(73) Assignee: Carlisle Fluid Technologies, Inc., Charlotte, NC (US)

( * ) Notice: Subject to any disclaimer, the term of this patent is extended or adjusted under 35 U.S.C. 154(b) by 137 days.

(21) Appl. No.: 14/200,808

(22) Filed: Mar. 7, 2014

(65) Prior Publication Data

US 2014/0183285 A1 Jul. 3, 2014

Related U.S. Application Data

(63) Continuation of application No. 12/908,618, filed on Oct. 20, 2010, now Pat. No. 8,690,083.

(51) Int. Cl.

| | |
|---|---|
| ***B05B 1/30*** | (2006.01) |
| ***B05B 12/00*** | (2006.01) |
| ***B05B 7/08*** | (2006.01) |
| ***B05B 7/12*** | (2006.01) |
| ***B05B 1/00*** | (2006.01) |
| *B05B 3/02* | (2006.01) |
| *B05B 5/025* | (2006.01) |
| *B05B 12/12* | (2006.01) |
| *B05B 12/14* | (2006.01) |
| *B05B 13/04* | (2006.01) |

(52) U.S. Cl.

CPC ..... *B05B 1/3033* (2013.01); *B05B 1/00* (2013.01); *B05B 1/30* (2013.01); *B05B 7/0815* (2013.01); *B05B 7/12* (2013.01); *B05B 12/002* (2013.01); *B05B 3/02* (2013.01); *B05B 5/025* (2013.01); *B05B 12/122* (2013.01); *B05B 12/1418* (2013.01); *B05B 12/1472* (2013.01); *B05B 13/0431* (2013.01); *Y10T 29/49826* (2015.01)

(58) Field of Classification Search

CPC ..... B05B 1/30; B05B 1/3033; B05B 9/01; B05B 12/002

See application file for complete search history.

(56) References Cited

U.S. PATENT DOCUMENTS

| | | | | |
|---|---|---|---|---|
| 4,776,368 | A | 10/1988 | Drozd | |
| 5,078,323 | A * | 1/1992 | Frank | 239/296 |
| 5,267,693 | A * | 12/1993 | Dickey | 239/417.3 |
| 5,478,014 | A | 12/1995 | Hynds | |
| 5,609,302 | A * | 3/1997 | Smith | 239/526 |
| 5,732,886 | A * | 3/1998 | Liaw | 239/526 |
| 6,276,616 | B1 * | 8/2001 | Jenkins | 239/526 |
| 6,634,570 | B2 * | 10/2003 | Scherer | 239/117 |
| 6,877,681 | B2 * | 4/2005 | Hartle et al. | 239/691 |
| 7,028,916 | B2 | 4/2006 | Micheli | |

(Continued)

*Primary Examiner* — Ryan Reis

(74) *Attorney, Agent, or Firm* — Fletcher Yoder P.C.

(57) ABSTRACT

A needle assembly may include a needle, a packing assembly that surrounds a first portion of the needle, and an actuatable adjustment element coupled to the packing assembly that changes a relationship between the needle and the packing assembly when actuated. The needle assembly may also include a base assembly that has a collar section and an elongated section. The elongated section includes a bore surrounding a second portion of the needle. The bore may terminate within the elongated section and before the collar section. The elongated section may be coupled to the second portion of the needle via an interference fit.

17 Claims, 7 Drawing Sheets

(56) References Cited

U.S. PATENT DOCUMENTS

| | | | | |
|---|---|---|---|---|
| 7,311,271 | B2 | 12/2007 | Micheli | |
| 7,568,635 | B2 | 8/2009 | Micheli | |
| 7,762,476 | B2 | 7/2010 | Micheli | |
| 7,789,327 | B2 | 9/2010 | Micheli et al. | |
| 7,950,598 | B2 * | 5/2011 | Olson et al. | 239/340 |
| 2004/0031860 | A1 | 2/2004 | Micheli | |
| 2004/0046040 | A1 | 3/2004 | Micheli | |
| 2004/0262416 | A1 | 12/2004 | Micheli | |
| 2005/0006498 | A1 | 1/2005 | Micheli | |
| 2006/0000928 | A1 | 1/2006 | Micheli | |
| 2006/0065760 | A1 | 3/2006 | Micheli | |
| 2006/0214027 | A1 | 9/2006 | Micheli | |
| 2007/0221762 | A1 | 9/2007 | Micheli et al. | |
| 2008/0017734 | A1 | 1/2008 | Micheli et al. | |
| 2008/0048055 | A1 | 2/2008 | Micheli | |
| 2008/0185009 | A1 | 8/2008 | Choncholas et al. | |
| 2008/0295768 | A1 | 12/2008 | Micheli et al. | |
| 2008/0296409 | A1 | 12/2008 | Micheli | |
| 2009/0148612 | A1 | 6/2009 | Micheli | |
| 2009/0230218 | A1 | 9/2009 | Drozd | |
| 2009/0277976 | A1 | 11/2009 | Micheli et al. | |
| 2009/0302133 | A1 | 12/2009 | Micheli et al. | |
| 2010/0006673 | A1 | 1/2010 | Micheli | |
| 2010/0050870 | A1 | 3/2010 | Gajjar et al. | |
| 2010/0108784 | A1 | 5/2010 | Drozd et al. | |

* cited by examiner

ADJUSTABLE NEEDLE PACKING ASSEMBLY FOR A SPRAY GUN

CROSS REFERENCE TO RELATED APPLICATIONS

This application is a continuation of U.S. patent application Ser. No. 12/908,618, entitled "ADJUSTABLE NEEDLE PACKING ASSEMBLY FOR A SPRAY GUN", filed Oct. 20, 2010, which is herein incorporated by reference.

BACKGROUND

The present technique relates generally to spray systems and, more particularly, to industrial spray coating systems. In particular, a system and method is provided for improving a triggered spray coating device.

This section is intended to introduce the reader to various aspects of art that may be related to various aspects of the present system and techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Spray coating devices are used to apply a spray coating to a wide variety of product types and materials, such as wood and metal. Such spray gun devices may be operated with a trigger assembly. Trigger actuation opens a needle valve, which in turn allows the spray coating material to flow through an opening of the spray gun. However, the needle valve assembly may become worn or damaged through repeated use. For example, repeated trigger actuation may bend the needle. In addition, the component parts of the needle assembly may become misaligned, which may prevent the valve from fully opening or closing. Accordingly, a more robust and reliable needle assembly is needed.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a needle assembly may include a needle, a packing assembly that surrounds a first portion of the needle, and an actuatable adjustment element coupled to the packing assembly that changes a relationship between the needle and the packing assembly when actuated. The needle assembly may also include a base assembly that includes a collar section and an elongated section. The elongated section may include a bore that surrounds a second portion of the needle and that terminates within the elongated section and before the collar section. The elongated section may be coupled to the second portion via an interference fit.

In a second embodiment, a spray coating device may include a body with a passage and a removable needle assembly within the passage. The removable needle assembly may include a needle, a packing assembly that surrounds a first portion of the needle, and an actuatable adjustment element that includes an interior portion and an exterior portion. The interior portion may be coupled to the packing assembly and the exterior portion may be accessible to an operator from an exterior of the body. The exterior portion may change a relationship between the needle and the packing assembly when actuated.

In a third embodiment, a method of manufacture includes coupling a packing assembly to a first portion of a needle and coupling an actuatable adjustment element to a second portion of the needle. The method of manufacture also includes coupling a base assembly that includes a collar section and an elongated section to a third portion of the needle. The elongated section includes a bore that surrounds the third portion of the needle and terminates within the elongated section and before the collar section.

DRAWINGS

The foregoing and other advantages and features of the invention will become apparent upon reading the following detailed description and upon reference to the drawings in which.

Figure 3:
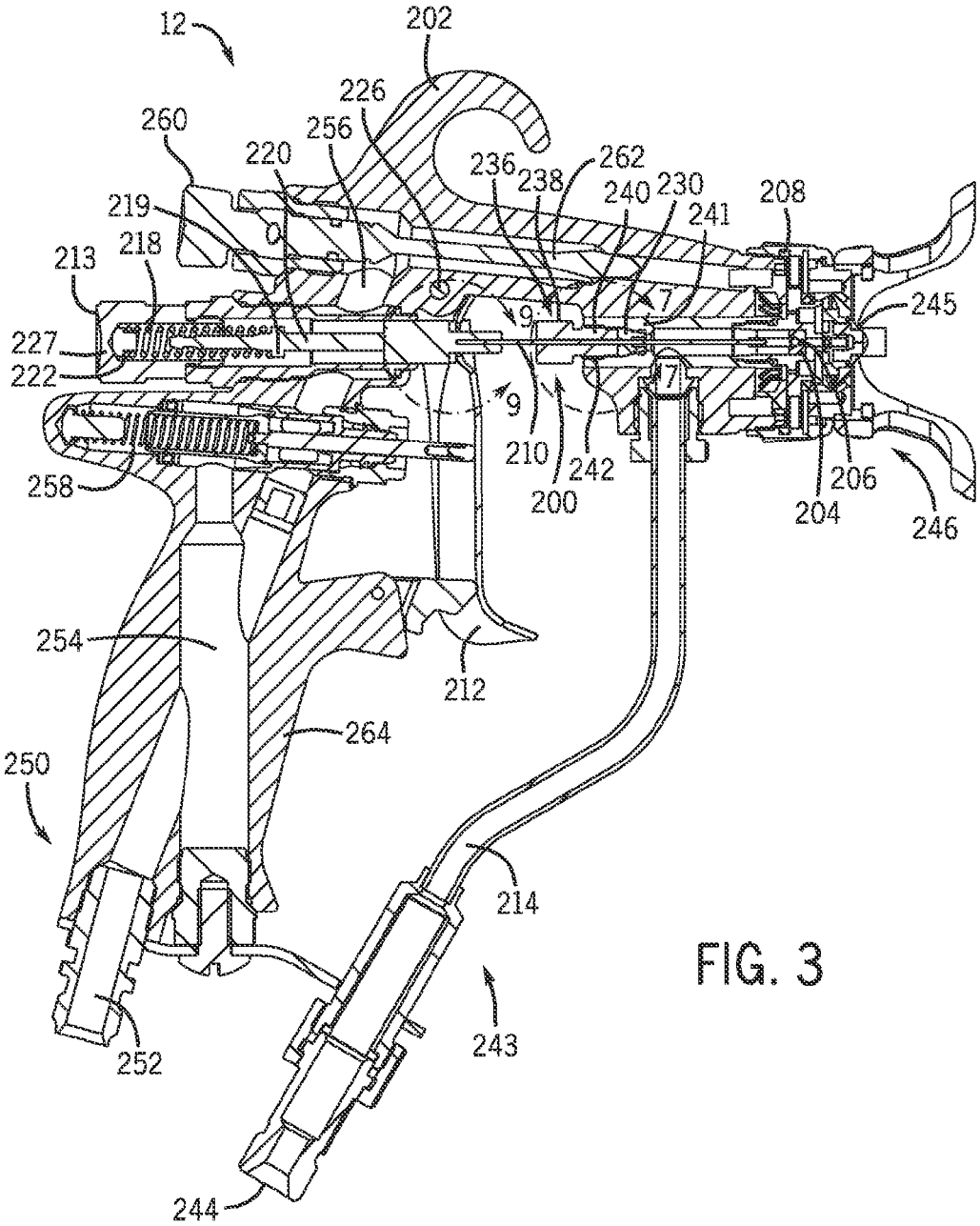
FIG. 3 is a cross-sectional side view of an embodiment of a spray coating device used in the spray coating system and method of FIGS. 1 and 2.
Figure 7:
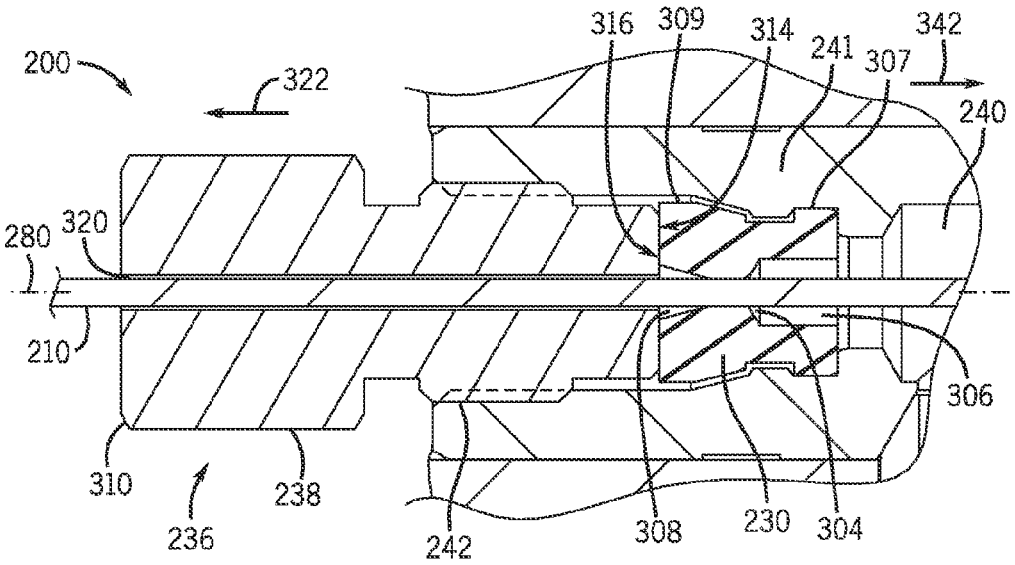
Figure 8:
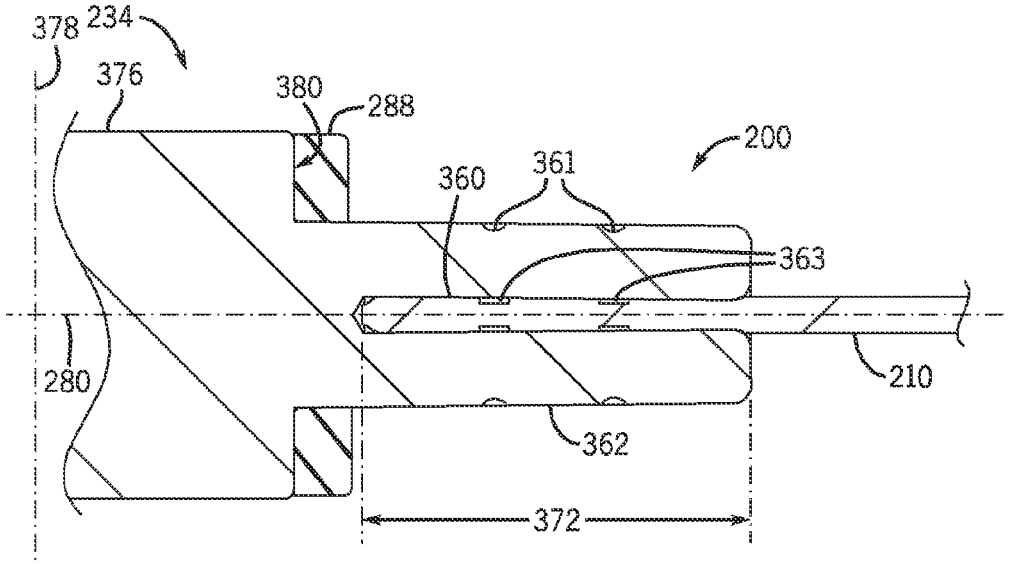
Figure 9:
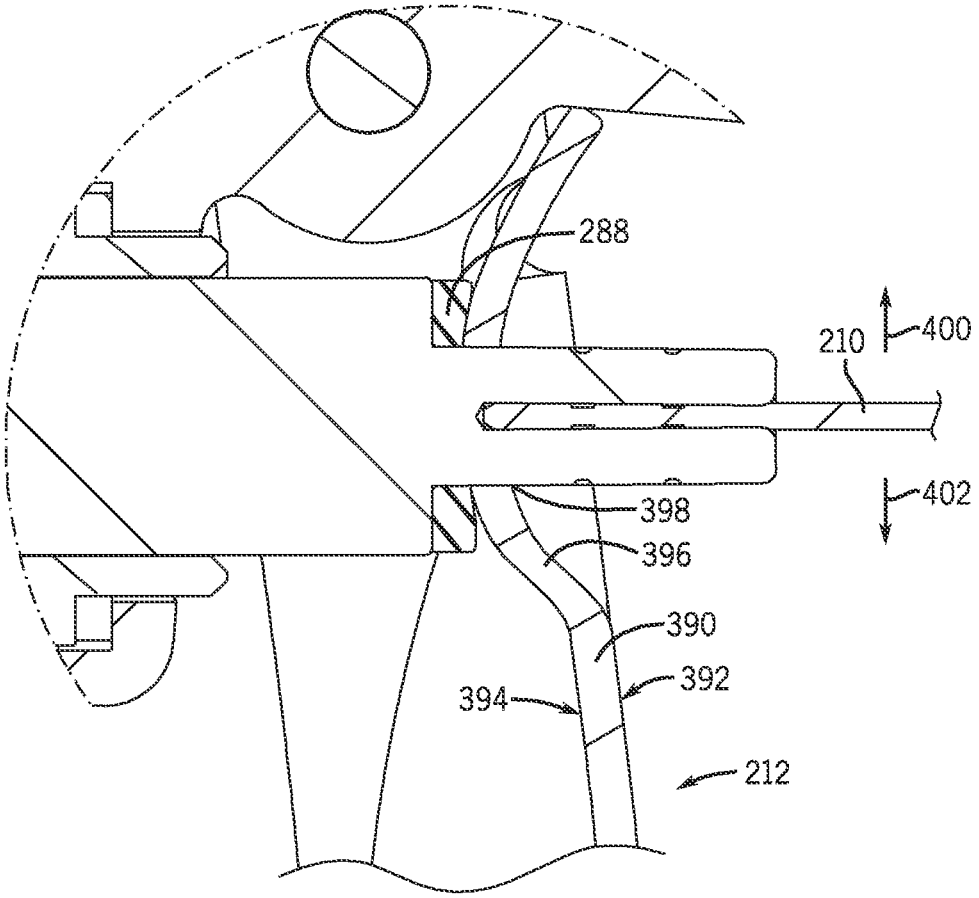

FIG. 7 a partial cross-sectional side view of the spray device taken through line 7-7 of FIG. 3;

FIG. 8 is a partial cross-sectional side view through line 8-8 taken within line 8-8, illustrating details of a base assembly; and FIG. 9 is a partial cross-sectional side view of the spray device of FIG. 3 illustrating details of the base assembly of FIG. 8 of the spray device of FIG. 3 through line 9-9.

DETAILED DESCRIPTION

As discussed in detail below, the present technique provides a spray gun for coating and other spray applications with an improved needle valve assembly. The needle valve assembly includes a needle and associated packing components. The needle assembly includes an adjustment feature that is accessible to an operator from the exterior of the spray gun. The adjustment feature, e.g., an adjustable nut, may be used to compress the needle seal, which in turn causes the seal to compress and tighten against the needle and against the internal surface of the spray gun in the region of the needle seal. In this manner, an operator may adjust the needle seal within the spray gun. In certain instances, pressures higher than 100 psi, the pressure of fluid inside a spray device may degrade the quality of packing around a needle valve. In particular, the disclosed adjustable packing provides sufficient sealing about the needle so that the packing is able to be used with both low pressure (0-100 psi) and medium pressure (300-4600 psi), or even higher pressure devices. Further, the needle assembly may be provided as a complete assembly (e.g., a one-piece or pre-assembled structure) that may be removed from the back side of the gun for cleaning or replacement.

In addition, a base of the needle assembly is coupled to a trigger for activating the spray coating by displacing the needle within a passageway. When the needle is displaced in the direction of the trigger pull, the valve opens and fluid is able to flow to a spray tip. Likewise, when the needle moves in the opposite direction in response to a trigger release, the valve closes. The trigger interacts with the base to displace the needle in its passageway. As provided, the base may be attached to the needle via a mechanical coupling, e.g., a crimped or interference fit. The mechanical coupling may improve the lifespan of the needle assembly by preventing the needle from becoming dislodged from or moving relative to its base. Further, the base assembly also includes non-metal, e.g., plastic or polymeric, washer components that directly contact the trigger assembly. By employing washers that are not metal, there is reduced metal-on-metal contact when the trigger is actuated. This results in a smoother trigger pull because of a decreased coefficient of friction for the movement of the needle, which in turn results in reduced vertical deflection of the needle during operation of the valve. The reduction of vertical deflection promotes a longer lifespan of the needle assembly, because vertical deflection contributes to bending of the needle and misalignment of the needle in the valve. An additional benefit of the non-metal washer includes quieter operation.

Figure 1:
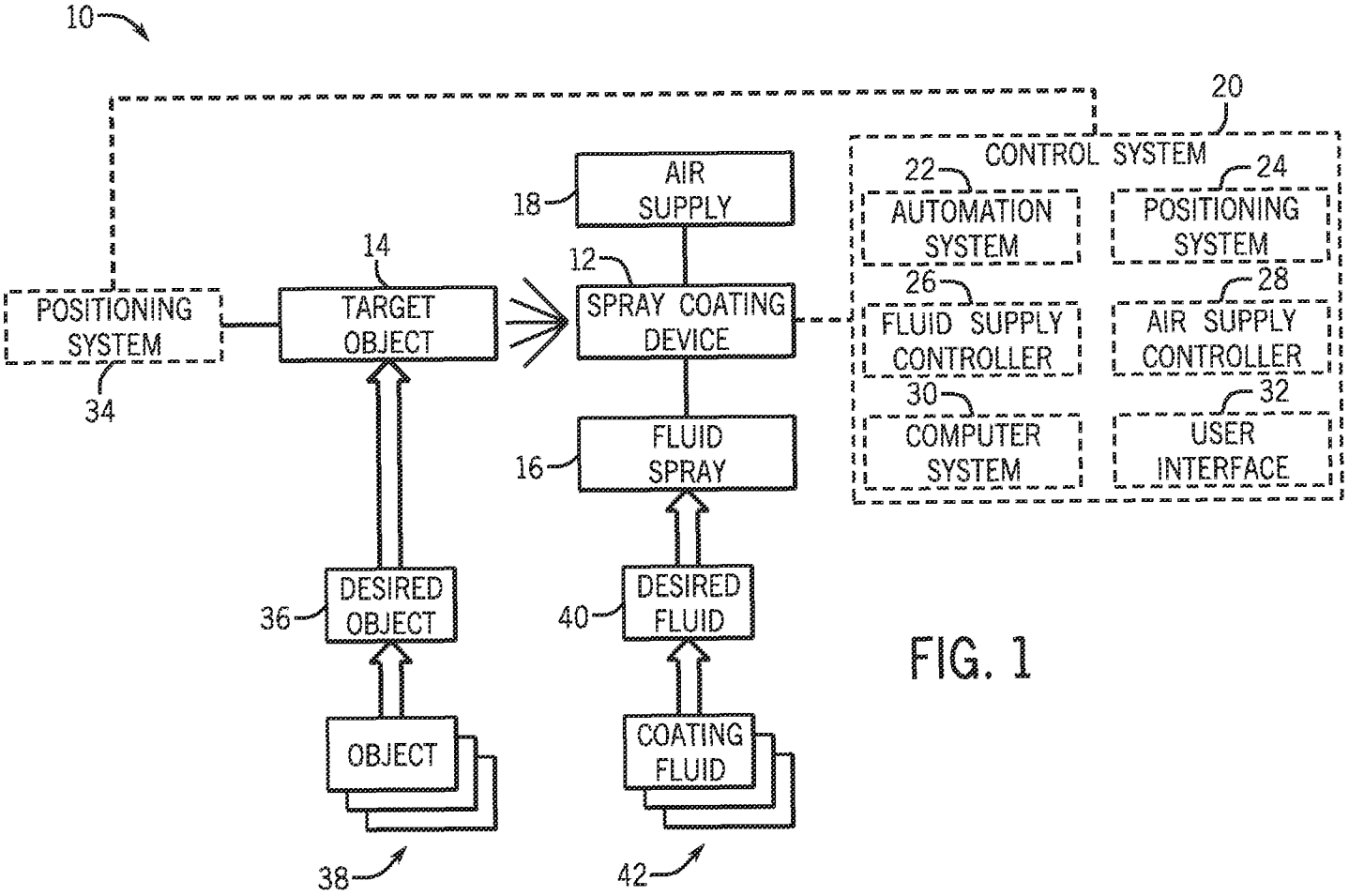
FIG. 1 is a diagram illustrating an embodiment of a spray coating system.

FIG. 1 is a diagram illustrating an exemplary spray coating system 10, which comprises a spray coating device 12 for applying a desired coating to a target object 14. The spray coating device 12 may be coupled to a variety of supply and control systems, such as a fluid supply 16, an air supply 18, and a control system 20. The control system 20 facilitates control of the fluid and air supplies 16 and 18 and ensures that the spray coating device 12 provides an acceptable quality spray coating on the target object 14. For example, the control system 20 may include an automation system 22, a positioning system 24, a fluid supply controller 26, an air supply controller 28, a computer system 30, and a user interface 32. The control system 20 also may be coupled to a positioning system 34, which facilitates movement of the target object 14 relative to the spray coating device 12. According, the spray coating system 10 may provide a computer-controlled mixture of coating fluid, fluid and air flow rates, and spray pattern. Moreover, the positioning system 34 may include a robotic arm controlled by the control system 20, such that the spray coating device 12 covers the entire surface of the target object 14 in a uniform and efficient manner.

The spray coating system 10 of FIG. 1 is applicable to a wide variety of applications, fluids, target objects, and types/configurations of the spray coating device 12. For example, a user may select a desired fluid 40 from a plurality of different coating fluids 42, which may include different coating types, colors, textures, and characteristics for a variety of materials such as metal and wood. The user also may select a desired object 36 from a variety of different objects 38, such as different material and product types. As discussed in further detail below, the spray coating device 12 also may comprise a variety of different components and spray formation mechanisms to accommodate the target object 14 and fluid supply 16 selected by the user. For example, the spray coating device 12 may be configured to use an air atomizer, a rotary atomizer, an electrostatic atomizer, or any other suitable spray formation mechanism.

Figure 2:
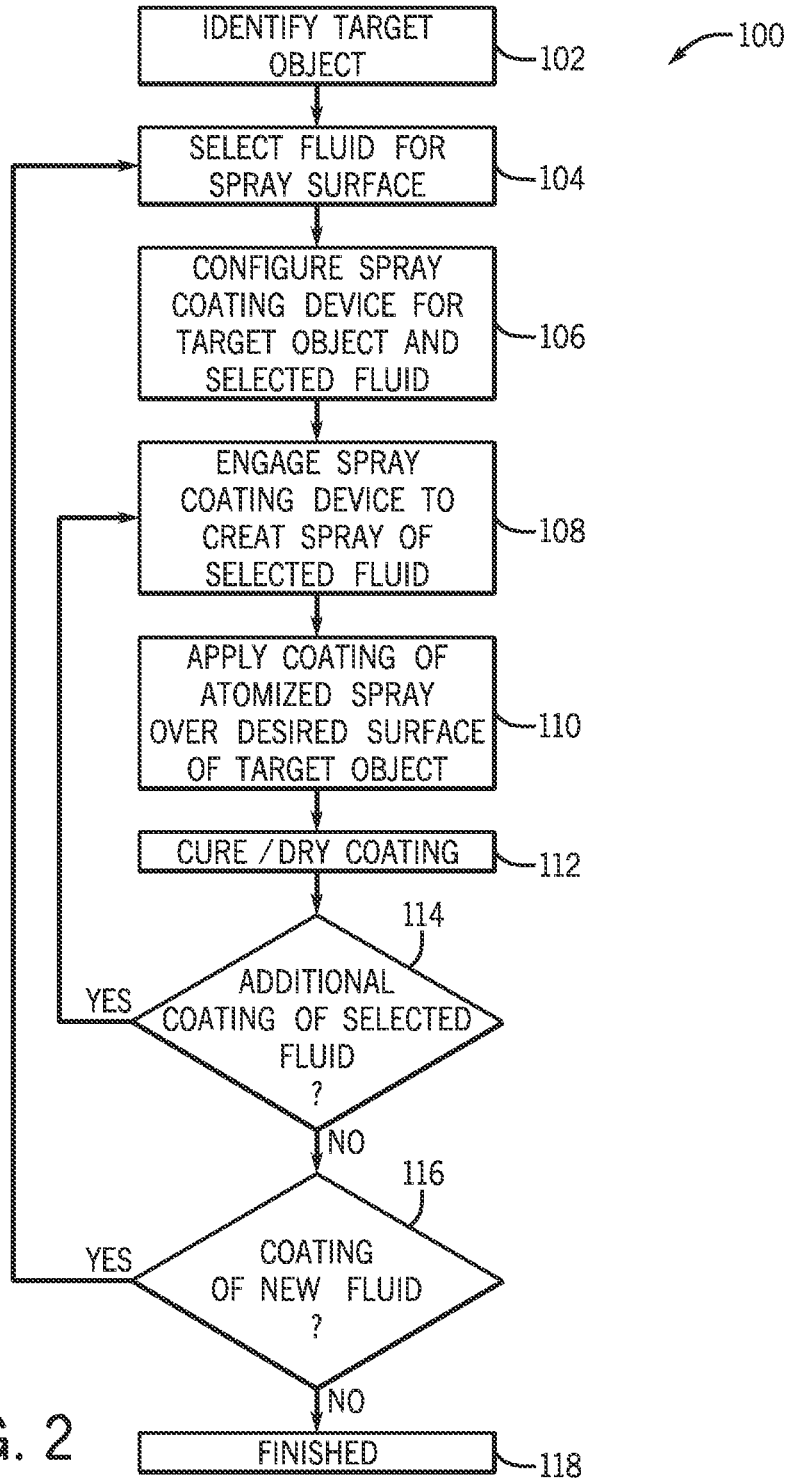
FIG. 2 is a flow chart illustrating an embodiment of a spray coating process.

FIG. 2 is a flow chart of an exemplary spray coating process 100 for applying a desired spray coating to the target object 14. As illustrated, the process 100 proceeds by identifying the target object 14 for application of the desired fluid (block 102). The process 100 then proceeds by selecting the desired fluid 40 for application to a spray surface of the target object 14 (block 104). A user may then proceed to configure the spray coating device 12 for the identified target object 14 and selected fluid 40 (block 106). As the user engages the spray coating device 12, the process 100 then proceeds to create an atomized spray of the selected fluid 40 (block 108). The user may then apply a coating of the atomized spray over the desired surface of the target object 14 (block 110). The process 100 then proceeds to cure/dry the coating applied over the desired surface (block 112). If an additional coating of the selected fluid 40 is desired by the user at query block 114, then the process 100 proceeds through blocks 108, 110, and 112 to provide another coating of the selected fluid 40. If the user does not desire an additional coating of the selected fluid at query block 114, then the process 100 proceeds to query block 116 to determine whether a coating of a new fluid is desired by the user. If the user desires a coating of a new fluid at query block 116, then the process 100 proceeds through blocks 104-114 using a new selected fluid for the spray coating. If the user does not desire a coating of a new fluid at query block 116, then the process 100 is finished at block 118.

FIG. 3 is a cross-sectional side view illustrating an exemplary embodiment of the spray coating device 12. As illustrated, the spray coating device 12 comprises a needle valve assembly 200 coupled to a body 202. The needle valve assembly 200 controls the opening of a passageway 206 that directs fluid to the fluid nozzle assembly 204, which may be removably inserted into a receptacle defined by the walls 241. The illustrated needle valve assembly 200 has a needle 210 extending movably through the body 202 between the fluid nozzle assembly 204 and a fluid valve adjuster 213. In operation, actuation of a trigger 212 results in displacement of the needle 210 of the needle valve assembly 200. This in turn allows fluid from fluid passage 214 to be directed towards the fluid nozzle assembly 204. The fluid valve adjuster 213 is rotatably adjustable against a spring 218 disposed between a flange 219 of a rear section 220 of the needle valve assembly 200 and an internal portion 222 of the fluid valve adjuster 213. The rear portion 220 is also coupled to the trigger 212, such that the needle valve assembly 200 may be moved inwardly away from the fluid nozzle assembly 204 as the trigger 212 is rotated counter clockwise about a pivot joint 226. The fluid valve adjuster 213 includes a cap piece 227 that may be removed from the body 202. After removal of the cap piece 227, the needle valve assembly 200 may be removed from the body 202, e.g., for replacement or repair. For example, the entire needle assembly 200 may be removed or installed as a complete assembly, which simplifies the process of maintenance and repair. Thus, the needle valve assembly 200 may be provided as a pre-assembled product. The needle 210 may be removed by unscrewing the fluid valve adjuster 213 and the adjustment element 236 and removing the cap piece 227 and the spring 218. The needle 210 or the needle valve assembly 200 may be removed by an operator by pulling on a rear of the needle valve assembly 200 and removing it through the back of the spray device 12.

The needle valve assembly 200 also may include a variety of packing and seal assemblies, such as packing assembly 230, disposed around the needle 210. The needle valve assembly 200 also includes an adjustment element 236 having an exterior portion 238 that extends into a passageway 240 surrounded by walls 241. An interior portion 242 is disposed within the passageway 240 between the walls 241 and contacts the packing assembly 230. In particular embodiments, the needle 210 and the base assembly 234 may be removed from the packing assembly 230 and adjustment element 236, e.g, by removing the cap piece 227 and sliding the base assembly 234 and needle 210 out through the open fluid valve adjuster 213 to remove the needle 210 from the spray coating device 12.

As noted, the needle valve assembly controls the opening and closing of the passageway 206 that allows fluid from fluid passageway 214 to enter the fluid nozzle assembly 204. As illustrated, a fluid delivery assembly 243 includes the fluid passage 214 extending from a fluid inlet coupling 244 to the fluid nozzle assembly 204. The body 202 of the spray coating device 12 includes a variety of controls and supply mechanisms for directing fluid to a spray tip assembly 246 having the fluid nozzle assembly 204. From the fluid nozzle assembly 204, fluid may enter an appropriate finishing atomization tip, such as an airless atomization tip 245, which may be removably secured to the body 202, for example via a retaining nut. The spray tip assembly 246 may also include a finger guard coupled to the trigger 212 and additional features for shaping the spray.

An air supply assembly 250 is also disposed in the body 202 to facilitate atomization at the spray tip assembly 246. The illustrated air supply assembly 250 extends from an air inlet coupling 252 to the atomization tip 245 via air passages 254 and 256. The air supply assembly 250 also includes a variety of seal assemblies, air valve assemblies, and air valve adjusters to maintain and regulate the air pressure and flow through the spray coating device 12. For example, the illustrated air supply assembly 250 includes an air valve assembly 258 coupled to the trigger 212, such that rotation of the trigger 212 about the pivot joint 226 opens the air valve assembly 258 to allow air flow from the air passage 254 to the air passage 256. The air supply assembly 250 also includes an air valve adjustor 260 coupled to a needle 262, such that the needle 262 is movable via rotation of the air valve adjustor 260 to regulate the air flow to the the air passage 256. As illustrated, the trigger 212 is coupled to both the needle valve assembly 200 and the air valve assembly 258, such that fluid and air simultaneously flow to the spray tip assembly 246 as the trigger 212 is pulled toward a handle 264 of the body 202. Once engaged, the spray coating device 12 produces an atomized spray, e.g., via hydraulic shearing and expansion in atomization tip 245, with a desired spray pattern and droplet distribution. Again, the illustrated spray coating device 12 is only an exemplary device of the present technique. Any suitable type or configuration of a spraying device and/or tip may be used in conjunction with the needle valve assembly 200 as provided.

Figure 4:
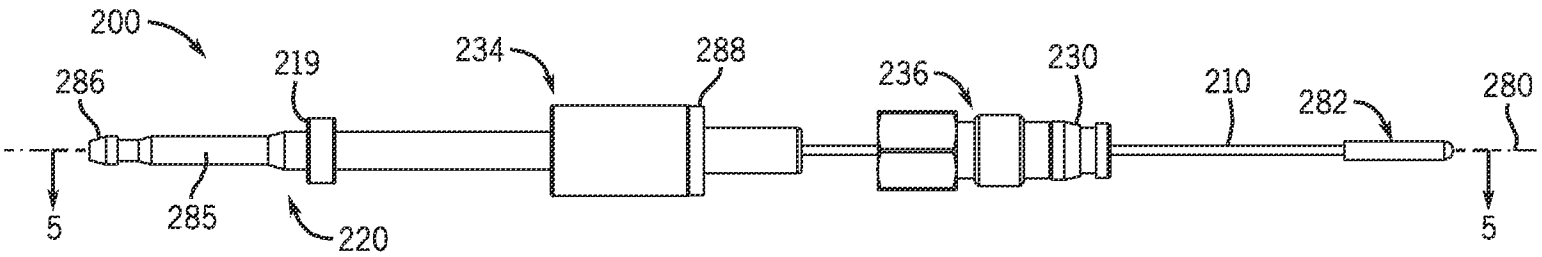
FIG. 4 is a side view of an embodiment of a needle assembly that may be used in conjunction with the spray device of FIG. 3.

FIG. 4 is a side view of an embodiment of the needle valve assembly 200 of FIG. 3. The needle valve assembly 200 includes a needle 210 that runs along axis 280. The needle 210 may be formed from a suitable metal wire or other material, e.g., stainless steel, tungsten carbide, polymers, or combinations thereof. It should be understood that the needle gauge and length 281 (see FIG. 5) may be selected to be compatible with the size and specifications of the spray coating device 12. The needle 210 terminates in a tip assembly 282 that functions to seal passageway 206 from the fluid nozzle assembly 204 (see FIG. 3). The needle valve assembly 200 also includes a packing assembly 230 coupled to the adjustment element 236 (e.g., threaded fastener). The packing assembly 230 forms a seal around the needle 210, preventing fluid in the passageway 206 or from the fluid nozzle assembly 204 from leaking around the needle valve assembly 200. The adjustment element 236 is coupled to the packing assembly 230 and is rotatably adjustable (e.g., rotatable) to compress the packing assembly around the needle 210. Further, the needle valve assembly 200 includes a base assembly 234 and washer 288 that together function to transfer the displacement force of the trigger 212. The base assembly 234 includes the rear portion 220 that is configured to be coupled to the fluid valve adjuster 213 of the spray coating device 12, as shown in FIG. 3. As shown in the illustrated embodiment, the rear portion 220 may include additional components that interact with the body 202 to couple the needle valve assembly 200 to various internal elements of the body 202. For example, the base assembly 234 may include elements that are sized and shaped to mate with various internal passageways of the body 202, such as the flange 219. The rear portion 220 may also include extending piece 285 that is sized and shaped to fit into the fluid valve adjuster 213. For example, as illustrated, the extending piece 285 terminates in an end cap 286 that, in operation, comes into contact with the interior portion 222 of the fluid valve adjuster 213. The needle valve assembly 200 may also include a washer 288 that substantially surrounds a portion of the base assembly 234 and is positioned to directly contact the trigger 212. The depicted components of the needle valve assembly 200 may be provided as a single unit or kit that may be replaced as a whole if particular components (e.g., the needle 210) reach their desired number of uses or for repair.

Figure 5:
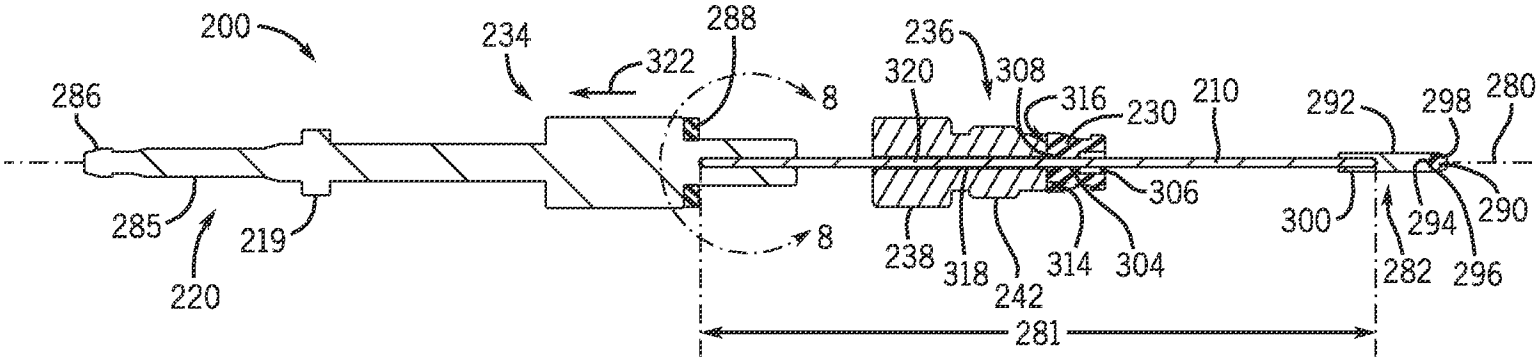
FIG. 5 is a cross-sectional side view through line 5-5 of FIG. 4, illustrating internal details of the needle assembly.

As seen in cross-section in FIG. 5, the individual components of the needle valve assembly 200 may be coupled together, e.g., mechanically or adhesively, to form a unitary assembly. For example, the needle 210 terminates at a tip assembly 282 that functions to directly contact the fluid nozzle assembly 204 to seal the passageway 206. The tip assembly 282 has a ball sealing component 290 formed from a suitable material, e.g., tungsten carbide, that is coupled to a holder 292, e.g., via brazing. The holder 292 has a notch 294 that receives a portion of the ball sealing component 290. An outer surface 296 of the ball sealing component 290 directly contacts a notch outer surface 298. The holder 292 also includes a bore 300 sized and shaped to accommodate the needle 210. The needle 210 is coupled to the holder 292 by an interference fit, a crimp fit, a threaded joint, a brazed joint, or another suitable coupling.

The needle 210 passes through the packing assembly 230 and the adjustment element 236. The packing assembly 230 has an integral bore 304 that accommodates the needle 210. In addition, the packing assembly 210 includes a first notch 306 and a second notch 308 that open around the needle 210. The notches 306 and 308 may be compressed and/or moved relative to the needle 210 to allow the sealing properties to be adjusted by the adjustment element 236, as discussed below. For example, in certain embodiments, the packing assembly 230 is formed from materials that are able to be compressed, e.g., rubber or elastomeric polymers.

The adjustment element 236 includes the exterior hex-shaped portion 238 and the interior portion 242. The interior portion 242 has an abutment surface 314 that directly contacts an end surface 316 of the packing assembly 230. The adjustment element 236 includes an integral bore 318 that aligns along axis 280 with the integral bore 304 to create a passageway 320 through which the needle 210 may slide. That is, in operation, the position of the needle 210 changes relative to the adjustment element 236 and the packing assembly 210. Actuation of the trigger 212 (see FIG. 3) results in displacement of the needle 210 along axis 280.

When the needle 210 is displaced by trigger 212 in the direction of arrow 322, the needle valve assembly 200 is in the open position. During such displacement, the needle 210 slides through passageway 320 in the direction of arrow 322 relative to the adjustment element 236 and the packing assembly 230.

Figure 6:
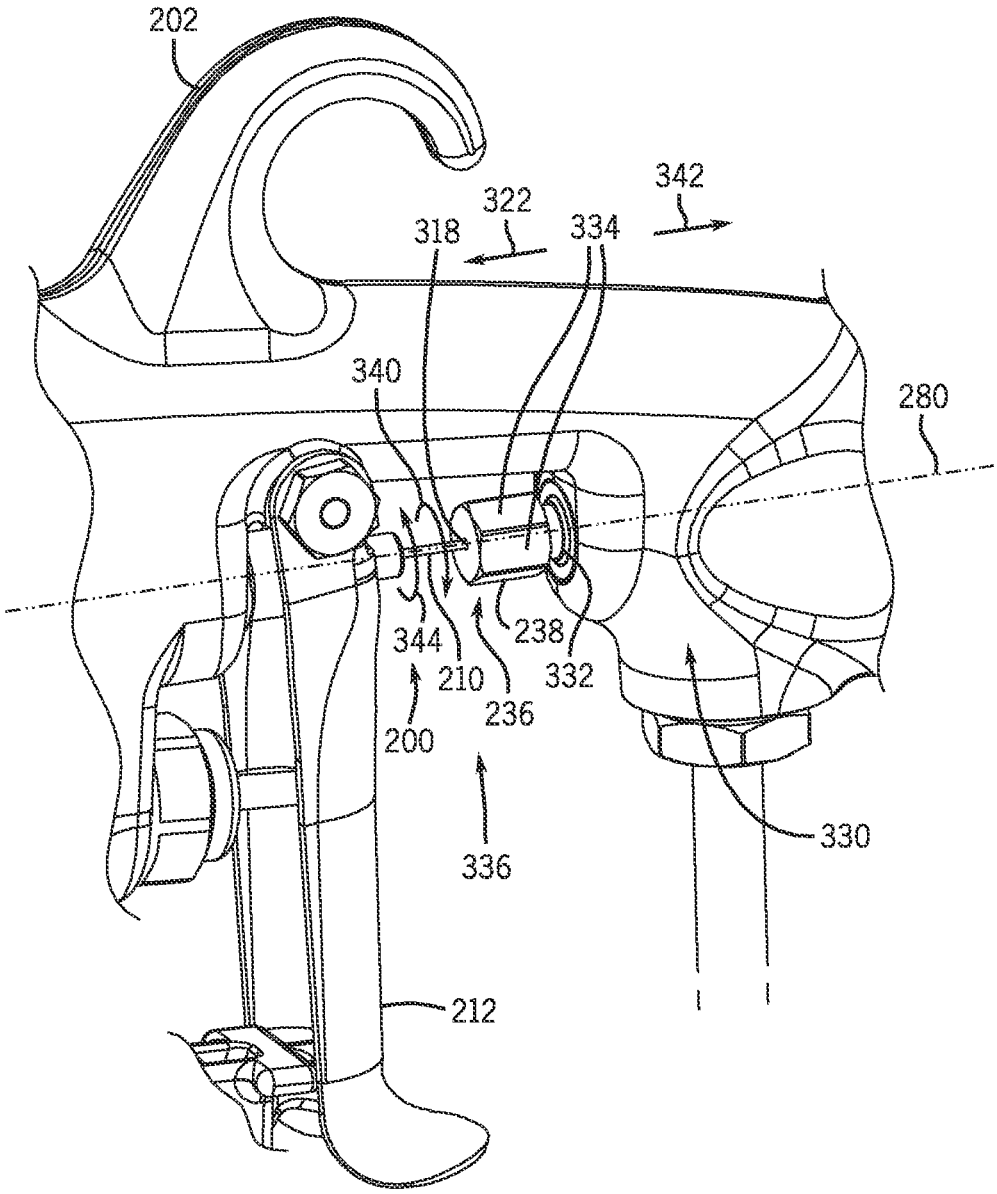
FIG. 6 is a partial perspective view of the spray device of FIG. 3, illustrating an adjustable element of the needle valve assembly taken within line 6-6 of FIG. 5.

FIG. 6 is a perspective view of the adjustment element 236 of the needle valve assembly 200. The illustrated adjustment element 236 includes an exterior portion 238 that may be accessed by an operator and rotated about an axis 280 formed by the needle 210. The exterior portion 238 of the adjustment element 236 is accessible from an exterior surface 330 of the body 202 and is coupled to interior portion 242, which directly contacts packing assembly 230, as shown in cross-section in FIG. 5. The body 202 includes a bore 332 (e.g., female threads) substantially sized and shaped to accommodate the exterior portion 238 (e.g., male threads). As illustrated, the adjustment element 236 may include one or more facets 334 for gripping and rotating the exterior portion 238. The adjustment element 236 is positioned on the exterior surface 330 in U-shaped opening 336 formed by the body 202 that is sized to allow an operator to pull and release the trigger 212. The adjustment element 236 is downstream of the trigger 212 in the direction of fluid flow. In operation, rotation of the exterior portion 238 of the adjustment element 236 in the clockwise direction, illustrated by arrow 340, moves (e.g., threads) the adjustment element 236 along the axis 280 in the downstream direction, shown by arrow 342. Similarly, rotation of the adjustment element 236 in the counterclockwise direction, shown by arrow 344, moves (e.g., threads) the adjustment element 236 along the axis 280 in the upstream direction, shown by arrow 322. Generally, the adjustment element 236 may be any suitable structure, such as a piston, plunger, screw, ratchet, or pin, that functions to compress and/or decompress or displace the packing assembly 230 while accommodating the needle 210, e.g., through integral bore 318.

FIG. 7 is a cross-sectional detail view through line 7-7 of the fluid packing assembly 230 of FIG. 3. The walls 241 form the passageway 240 that surrounds packing assembly 230 and the interior portion 242 of the adjustment element 236. The adjustment element 236 substantially surrounds the needle 210 and includes the bore 318 defining the passageway 320 through the exterior portion 238 and the interior portion 242 through which the needle 210 passes. However, if a fluid leak forms, an operator may actuate the adjustment element 236 to tighten a seal around the needle valve assembly 200. Rotation of the exterior portion 238 of the adjustment element 236 in the clockwise direction moves (e.g., threads) the adjustment element 236 along the axis 280 in the downstream direction, shown by arrow 342. This pushes the interior portion 242 axially against the packing assembly 230 at the abutment interface of the end surface 314 of the interior portion 242 and the end surface 316 of the packing assembly 230. This pushes the packing assembly 230 against the walls 240 surrounding the passageway 241. For example, the walls 240 may be tapered, conical, or generally converging in the direction 342, thereby radially compressing the packing assembly 230 during axial movement in the direction 342. As a result, the packing assembly 230 progressively squeezes the needle 210 within the passageway 241 to form an improved seal, e.g., by compressing the bore 304 or one or both of notches 306 and 308. The packing assembly also includes ridges or flanges 307 and 309 disposed about the respective notches 306 and 308. These flanges 307 and 309 impart a radial force onto notches 306 and 308 to facilitate compression during movement of the packing assembly 230. The radial force created by the movement of the adjustment element 236 against the packing assembly 230 changes the relationship between the needle 210 and the packing assembly 230, which may eliminate or reduce any leaks caused by misalignment of these elements. For example, if the packing assembly 230 is formed from a compressible material, the compression force of the interior portion 242 pushing against the packing assembly 230 tightens the packing assembly 230 around the needle 210. If the packing assembly 230 is formed from a relatively incompressible material, e.g., metal or an incompressible plastic, the radial force from the movement of the interior portion 242 along arrow 342 may act to displace the packing assembly 230 in the direction of arrow 342, which may serve to better align the needle 210, the packing assembly 230, and the passageway 241 relative to the axis 280.

Similarly, rotation of the adjustment element 236 in the counterclockwise direction moves the adjustment element 236 along the axis 280 in the upstream direction, shown by arrow 322. This allows the packing assembly 230 to decompress. In this manner, an operator may adjust the tightness of a seal around the needle valve assembly 200. Further, while the illustrated embodiment shows that the compression or displacement of the packing assembly 230 may generally occur along the axis 280, other arrangements of the adjustment element 236 relative to the packing assembly are contemplated. For example, the adjustment element 236 may be arranged to compress the packing assembly 230 along other axes.

During displacement of the needle 210, the base assembly 234 and the washer 288 move together with the needle 210 in the direction of arrows 322 and 342. As illustrated, the needle 210 terminates within a bore 360 of the base assembly 234, seen in detail in FIG. 8. The bore 360 is sized and shaped to accommodate the needle 210 and provide an interference fit. For example, the bore 360 may be tapered around the needle 210. In certain embodiments, the base assembly 234 and needle 210 are coupled together via a crimp fit 361. That is, during manufacture of the needle valve assembly 210, the needle 210 is inserted into the bore 360 and pressure is applied at one or more circumferential locations around elongated section 362 to crimp (e.g., radially compress) the elongated section 362 around the needle 210. In particular embodiments, the crimping pressure may be applied to the elongated section 362 at two or more points circumferentially opposite one another. Then, the base assembly 234 may be rotated to apply pressure at two different points circumferentially opposite one another. In particular embodiments, the needle 210 may be shaped to include variable diameter regions 363, e.g., with a smaller diameter. As illustrated, the variable diameter regions 363 may allow the crimp fit 361 to more fully extend into the bore 360 and around the needle 210. Accordingly, the variable diameter regions 363 may correspond to the crimping locations. In this manner, the needle 210 is mechanically coupled to the base assembly 234. This coupling may provide certain advantages relative to chemical or adhesive couplings. In particular, because the base assembly 234 transfers force from the trigger 212 to the needle 210, a relatively robust coupling that is capable of withstanding repeated application of the trigger force is desirable. The depicted crimped interference coupling reduces separation of the needle 210 from the base assembly 234 relative to needle assemblies with adhesive couplings between a needle component and a base component. However, it should be understood that the crimped interference coupling of the needle 210 to the base assembly 234 may, in particular embodiments, be used in conjunction with an adhesive or chemical coupling. In addition, the strength of the coupling may be related to the length of the portion of the needle 210 that is fitted with the bore 330. The needle 210 has a length 281 (see FIG. 5) that is selected to be compatible with the size and shape of the body 202. A portion 372 of the needle 210 that is fitted within bore 360 may represent a percentage of the length 281. In particular embodiments, the portion 372 represents less than about 25%, 20%, 15%, 10% or 5% of the length 281 of the needle 210.

The base assembly 234 also includes a collar section 376 that has a larger diameter than the elongated section 362 along an axis 378 substantially orthogonal to the axis 280. The difference in diameter between the collar section 376 and the elongated section 362 creates a stepped end surface 380 that abuts the washer 288. The washer 288 functions to directly contact the trigger 212 and transfer force from the trigger pull along the needle valve assembly 200. FIG. 9 is a detailed cross-sectional view of the base assembly 234 in the spray coating device of FIG. 3. The trigger 212 has a frame 390 that has an exterior surface 392 accessible to an operator, e.g., to grip the trigger 212, and an interior surface 394. The frame 390 includes a curved portion 396 that includes an opening 398 sized and shaped to accommodate the elongated section 362 of the base assembly 234. The interior surface 394 directly contacts the washer 288 when the trigger 212 is pulled or released. This contact displaces the needle 210 to open and close the fluid passageway 206. In particular embodiments, the washer 288 is formed from a material that functions to damp the force of the trigger pull so that inappropriate vertical deflection, e.g., along arrows 400 and 402, is reduced. For example, the washer 288 may be formed from suitable non-metal materials, including polymers, rubber, or impact-absorbing solids. In particular embodiments, the washer 288 may be formed or coated with low friction materials including nylon, carbon films, acetal, Teflon®, or lubricated polymers. Because the frame 390 is typically metal, the elimination of metal-on-metal contact between the base assembly 234 and the interior surface 392 of the frame 390 results in reduced vertical deflection of the needle 210. In addition, the reduction of metal-on-metal contact may reduce noise during trigger operation. In certain embodiments, the washer 288 is separable from the needle assembly 200, while in other embodiments, the washer 288 is adhered or otherwise coupled to the base assembly 234.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a needle valve assembly comprising:

a needle;

a packing assembly substantially surrounding at least a first portion of the needle;

an actuatable adjustment element accessible to an operator for hand rotation and coupled to the packing assembly and configured to change a relationship between the needle and the packing assembly when rotated by the operator relative to the packing assembly; and a base assembly comprising a collar section and an elongated section, wherein the elongated section comprises a bore surrounding a second portion of the needle, the bore terminates within the elongated section and before the collar section, and the elongated section is coupled to the second portion via an interference fit.

2. The system of claim 1, wherein the packing assembly comprises a compressible material and the actuatable adjustment element is configured to compress the packing assembly when actuated.

3. The system of claim 1, wherein the packing assembly comprises at least one of a rubber or an elastomeric polymer.

4. The system of claim 1, wherein the actuatable adjustment element comprises an abutment surface that directly contacts the packing assembly.

5. The system of claim 1, wherein the elongated section is further coupled to a third portion via at least one of an adhesive or a chemical coupling.

6. The system of claim 1, wherein the interference fit comprises a crimp fit.

7. The system of claim 1, wherein the actuatable adjustment element comprises a threaded fastener.

8. The system of claim 1, wherein the system comprises a washer substantially surrounding at least a portion of the elongated section and abutting an end surface of the collar section.

9. The system of claim 1, comprising a spray coating device having the needle valve assembly.

10. A method, comprising:

coupling a packing assembly to a first portion of a needle;

coupling an actuatable adjustment element to a second portion of the needle such that the actuatable adjustment element has rotational freedom relative to the needle when manually rotated by an operator; and coupling a base assembly comprising a collar section and an elongated section to a third portion of the needle, wherein the elongated section comprises a bore substantially surrounding the third portion of the needle and the bore terminates within the elongated section and before the collar section.

11. The method of claim 10, comprising configuring the actuatable adjustment element to change a relationship between the needle and the packing assembly when actuated.

12. The method of claim 11, wherein the packing assembly comprises a compressible material, wherein configuring the actuatable adjustment element to change the relationship between the needle and the packing assembly comprises configuring the actuatable adjustment element to compress the packing assembly.

13. The method of claim 10, comprising coupling a washer to the elongated section.

14. The method of claim 10, wherein coupling the elongated section to the third portion of the needle comprises crimping the elongated section around the third portion of the needle.

15. The method of claim 10, wherein coupling the elongated section to the third portion of the needle comprises creating at least one of an adhesive or chemical coupling.

16. The method of claim 10, wherein the actuatable adjustment element comprises an abutment surface, and coupling the actuatable adjustment element to the second portion of the needle comprises configuring the abutment surface to directly contact the packing assembly.

17. A method, comprising:

unscrewing a fluid valve adjuster of a spray device;

removing a cap of the fluid valve adjuster of the spray device;

removing a needle valve assembly from the spray device, wherein the needle valve assembly comprises:

a needle;

a packing assembly disposed around the needle;

an adjustable element coupled to the packing assembly; and a base assembly, wherein the base assembly comprises a rear portion that is configured to be coupled to the fluid valve adjuster; and installing a replacement needle valve assembly in the spray device.

* * * * *